United States Patent [19]

Meywald et al.

[11] 4,350,872

[45] Sep. 21, 1982

[54] ELECTRICAL HEATING ELEMENT FOR FLUID MEDIA AND METHOD FOR PRODUCING SAME

[75] Inventors: Klaus Meywald; Helmut Ohnmacht, both of Kandel, Fed. Rep. of Germany

[73] Assignee: Firma Fritz Eichenauer, Kandel, Fed. Rep. of Germany

[21] Appl. No.: 91,460

[22] Filed: Nov. 5, 1979

[30] Foreign Application Priority Data

Nov. 14, 1978 [DE] Fed. Rep. of Germany ..... 2849266

[51] Int. Cl.[3] ..... H05B 3/02

[52] U.S. Cl. ..... 219/376; 219/375

[58] Field of Search ..... 219/364, 368, 369, 370, 219/374–376, 380–382, 542; 338/296–300, 302, 304, 305, 315, 317, 318, 319; 336/207

[56] References Cited

U.S. PATENT DOCUMENTS

| | | | |
|---|---|---|---|
| 608,343 | 8/1898 | McElroy | 338/305 |
| 677,862 | 7/1901 | Dwyer | 336/207 |
| 907,871 | 10/1908 | Blanchard | 219/370 |
| 1,419,330 | 6/1922 | Van Dyke | 219/542 |
| 1,608,673 | 11/1926 | Schroder | 336/207 |
| 1,827,788 | 10/1931 | Hicks | 219/375 |
| 1,840,168 | 1/1932 | Mucher | 338/321 |
| 4,003,388 | 1/1977 | Nopanen | 219/364 |
| 4,008,869 | 5/1978 | Nopanen | 219/370 |
| 4,230,933 | 10/1980 | Glucksman | 219/375 |

FOREIGN PATENT DOCUMENTS

| | | | |
|---|---|---|---|
| 662078 | 6/1938 | Fed. Rep. of Germany | 219/370 |
| 2138709 | 2/1973 | Fed. Rep. of Germany | 219/375 |
| 2263260 | 6/1974 | Fed. Rep. of Germany | 219/375 |
| 2331872 | 10/1977 | France | 336/207 |
| 80607 | 7/1918 | Switzerland | 219/542 |
| 89511 | 6/1921 | Switzerland | 219/375 |
| 210497 | 1/1924 | United Kingdom | 219/375 |

*Primary Examiner*—Bernard Roskoski

*Attorney, Agent, or Firm*—Craig and Antonelli

[57] ABSTRACT

An electrical heating element for fluid media, more particularly for hot air appliances, comprising a support member of insulating material and at least two heating conductors which are made of resistance wire and which surround the support member, the heating conductors being wound as helical coils and supported on supporting edges of the support member, the coils being wound with radial spacing from one another. The heating conductors may comprise an outer coil consisting of a resistance wire of high specific power consumption and an inner coil consisting of a resistance wire of low specific power consumption. The support member may comprise a tubular body with ribs projecting radially at the periphery, said ribs forming the supporting edges. The outer ribs may be U-shaped extending from end to end of the tubular body and forming passages through which the turns of the inner coil pass. The ribs preferably comprise mica strips; various mounting means for such strips are described.

12 Claims, 4 Drawing Figures

ELECTRICAL HEATING ELEMENT FOR FLUID MEDIA AND METHOD FOR PRODUCING SAME

The invention relates to an electrical heating element for fluid media, more particularly for hot air appliances, comprising a support member made of insulating material and at least two heating conductors of resistance wire surrounding the support member, the heating conductors being wound as helical coils and supported on supporting edges of the support member.

Heating elements of this construction are used more especially in fan- or blower-operated appliances for the heating of air, for example in hair dryers, fan heaters etc. In the case of such hot air appliances there is often a need to select various heating stages, for which purpose a plurality of separately switchable coils are provided. Moreover for example hair dryers are known in the operation of which a certain basic heating power is applied constantly, and an adjustable additional heating power is additionally available which for example is so regulated that the temperature of the issuing heated air varies in accordance with a given time pattern. In such cases, also, heating elements are used which have a plurality of separately switchable coils. Usually the coils are so arranged relatively to one another and to the supporting member, in coxial situations, that the air being heated flows through them in an axial direction.

In a known heating element of the category described the supporting member comprises a flat plate of insulating material about which two coils identical in their electrical properties are wound in bifilar arrangement. Different heating stages can be selected by individual or parallel connection of these two coils.

This known heating element has not as yet been found completely satisfactory for various reasons. There are problems in the manufacturing sector since when producing the bifilar winding both coils have to be applied simultaneously. This proves difficult more particularly if the coils—in accordance with the adaptation of the different power stages—comprise heating conductors which differ in wire thickness, wire profile, wire quality etc., and accordingly exhibit different coil behaviour. Troubles arise in operation also, owing to the fact that the coils of the bifilar windng are in intimate thermal contact relatively to one another and consequently each is acted upon by the heat given off by the other coil. As a result, the operating properties of each coil depend to a considerable extent on whether the other coil is in operation. This is disadvantageous more especially when the coils are designed with different specific heating power values. This means that with that known construction, which in any case allows a compact constructional arrangement only to a limited degree, a further reduction in winding density must be effected in order to obviate these disburbances which the coils cause on one another.

The invention has as its object to indicate an electrical heating element of the category initially described which can be produced in a simple and nonproblematic manner, is notable for compact constructional arrangement and is free of detrimental mutual influencing of the coils.

According to the invention this object is achieved in the first instance and above all by winding the coils with radial spacing relatively to one another. Thus the invention proposes that the coils—which are usually coaxial relatively to one another and to the supporting member—are not situated in a common layer but are each wound in their own respective layer, and surround one another because of the radial spacings from one another from the inside to the outside. Consequently the individual coils can be wound independently of one another and, if appropriate, with different pitch also, and there can be no disturbances in the winding operation from different winding behaviour of the different heating conductors. A heating element according to the invention is characterised by an extremely compact constructional arrangement, and more particularly the arrangement of the coils in different, radially separate, winding layers substantially excludes the possibility of the heating conductors influencing one another. Some increasing of the diameter of the heating element due to the radial spacings is relatively insignificant, since neither can certain minimum winding radii be gone below in any event with known heating elements.

The construction of an electrical heating element as proposed in the present invention is found to be particularly advantageous if not only are several heating conductors provided but these are also differently designed. For this purpose the invention provides a preferred arrangement which comprises an outer coil comprising a resistance wire of high specific power consumption and an inner coil comprising a resistance wire of low specific power consumption. In this context the expression specific power consumption means the heating power from conversion per unit of length of the heating conductor. Thus according to the invention the radially outer coil is constructed as a high power coil which has a relatively small electrical resistance per unit of length and thus a relatively large wire cross-section. The radially inner coil is designed for a low power consumption and accordingly with a relatively high resistance per unit of length. This arrangement is particularly recommended in hot air appliances such as hair dryers or the like, wherein a relatively low and constant basic heating lever is provided and also a relatively intense regulated additional heating level. It is advantageous to provide the inner low-power coil with a relatively small wire cross-section for the basic heating and the outer high-power coil with a large wire cross-section for the additional heating. The heating conductor of the inner coil preferably comprises a resistance wire of small cross-section wound about a supporting core—for example made of glass filament. The heating conductor of the outer coil itself can be wound for example in a spiral formation, but it is particularly recommended to use a construction comprising a resistance wire of rectangular cross-section formed with meander or sinuous loops. In order to reduce the influences of the coils on one another to the minimum it is particularly recommended to wind the inner and outer coils in opposite directions.

The support member for the coils is preferably constructed as a tubular body with ribs which form the supporting edges and which project from the periphery in radial directions. It is particularly advantageous to arrange in the interior of the usually circular-cylindrically shaped tubular body a blower motor and/or an electronic circuit for control of the motor and/or the heating. The ribs usually extend parallel to the longitudinal axis of the tubular body and are distributed uniformly over the periphery of the tubular body, the radial spacings of the supporting edges being arranged of course in accordance with the coil diameters. It is also expedient to provide the supporting edges with edge incisions or indentations whereby the individual turns of the coils are fixed in the axial sense.

A particularly preferable form of the support member is characterised in that the outer ribs associated with the outer coil have, in radial planes, a U-shaped profile with the legs of the U directed towards the tubular body and the crossbar of the U forming the supporting edge, the U-legs and U-crossbar bounding a passage for the inner coil, which is supported on the inner ribs. It is also proposed that at least the outer ribs are connected to the tubular body with holding elements. In other words, the outer ribs, but preferably the inner ribs also, are made separate from the tubular body and connected to the tubular body during the course of the manufacture of the heating element. The tubular body can readily be produced from a thermoplastic plastics material of suitable resistance to heat, for example using an extrusion process, whilst the outer and inner ribs consist preferably of synthetic mica.

The holding elements can comprise holding projections which are formed on the tubular body at the ends and on which the ribs are supported and/or secured. More particularly the holding projections can constitute at the same time the aforesaid U-legs of the outer ribs, so that only the U-crossbars have to be connected to the holding projections. On the other hand, in view of production of the tubular body by extrusion, the particularly advantageous possibility exists of constructing the holding elements as axially disposed reception slots into which the ribs are adapted to be inserted. In every case it is expedient to cement the ribs to the tubular body or the holding elements as the case may be.

When a heating element according to the invention is produced, usually first of all the inner coil will be wound on the supporting member provided with inner ribs, and then the outer ribs will be put on, and finally the outer coil will be wound. The fixing and electrical connection of the coils can be effected for example by means of lugs or rivets on the tubular body or on inner or outer ribs. These production steps can be carried out in a simple and unproblematic manner and are readily fitted into an easily supervised production cycle.

The invention will be discussed in detail hereinafter with the help of the accompanying drawings which show just one constructional example. In these drawings.

Figure 1:
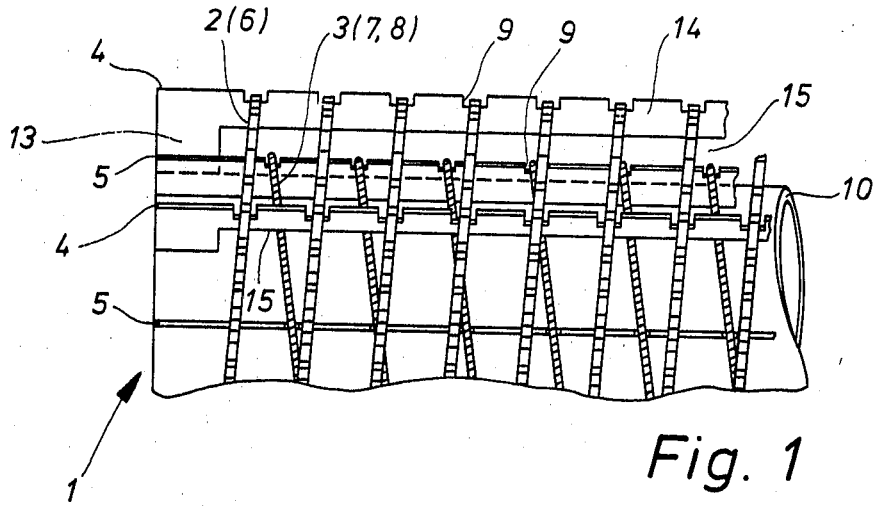
FIG. 1 shows an electrical heating element in side view, partly broken away.
Figure 2:
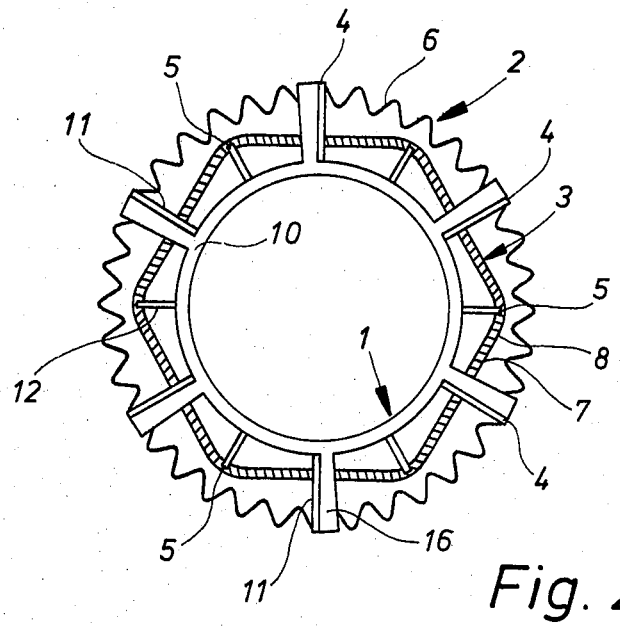
FIG. 2 shows the subject of FIG. 1 in end view.

The electrical heating element shown in FIGS. 1 and 2, which is intended for a hair dryer, comprises basically a support member 1 of insulating material and two heating conductors 2, 3 of resistance wire which surround the support member 1. The heating conductors 2, 3 are wound about the support member 1 in the form of helical coils coaxial with one another and with the support member 1, and they are supported on supporting edges 4, 5 of the support member 1. Both heating conductors are so connectable to an electrical current source as to be controlled independently from one another in a manner not shown in detail.

The two coils 2, 3 are wound with radial spacing from one another, so that there are an outer coil 2 and an inner coil 3 coaxial with one another, and they are correspondingly supported on outer supporting edges 4 and inner supporting edges 5. FIG. 2 shows how the coils 2, 3 are situated as it were in two concentric wound layers the outer of which surrounds the inner.

The outer coil 2 comprises a resistance wire 6 of high specific power consumption, which in the illustrated constructional example is formed with meander or sinuous coils or loops, has a rectangular cross-section and is secured on the outer supporting edges 4 by making a meander loop always engage over the supporting edge. The inner coil 3 comprises a resistance wire 7 of small specific power consumption, which has a correspondingly small cross-section and is wound about a supporting core 8 of glass filament, which is itself tensioned over the inner supporting edges 5. To secure the turns of the coils 2, 3 in the axial sense, the supporting edges 4, 5 are provided with edge incision or indentations 9 which at the same time define the turn pitch, which is different for the inner and outer coils. Also, in the illustrated constructional example the outer coil 2 and inner coil 3 are wound in opposite directions, which FIG. 1 shows clearly.

In more detail, the support member 1 comprises a tubular body 10 of circular cylinder form and with ribs 11, 12 which project radially at the periphery, are distributed uniformly over the periphery of the tubular body 10 and form the supporting edges 4, 5. Along the periphery of the tubular body 10, outer ribs 11 with the outer supporting edges 4 associated with the outer coil 2 are in alternating sequence with inner ribs 12 with the inner supporting edges 5 associated with the inner coil 3 (cf. FIG. 2).

While not shown in the drawings, the blower motor of the hair dryer and also an electronic regulating system can be arranged in the interior of the tubular body 10. The inner coil 3, which is designed for low power consumption, is provided for a relatively low, constant basic heating facility, whilst the outer coil 2, designed for high power consumption, makes available additional heating which is at first considerable and decreases over a period of time in accordance with a preset programme. Regulation of the additional heating is effected in accordance with the outflow temperature of the heated air by the electronic control system which can be situated within the tubular body 10, said temperature being measured by means of a temperature sensor (not shown).

In radial planes, one of which coincides with the drawing plane in FIG. 1, the outer ribs 11 associated with the outer coil 2 have a U-shaped profile with the legs 13 of the U directed towards the tubular body 10 and with the crossbar 14 forming the outer supporting edge 4. The U legs 13 and cross-bar 14 bound a passage 15 through which the turns of the inner coil 3 extend (cf. FIG. 2).

In the constructional example the ribs 11, 12 are made of synthetic mica, are produced separately from the tubular body 10, consisting of a thermoplastics material of suitable heat resistance, and are connected to the tubular body 10 by means of holding element during the course of the manufacture of the heating element.

Figure 3:
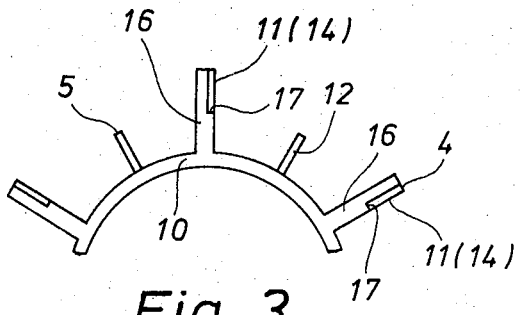
FIG. 3 shows a partial view of another form of embodiment of the subject of FIG. 2.

In the case of the forms of embodiment shown in FIGS. 2 and 3 the holding elements for the outer ribs 11 comprise holding projections 16 which are formed on the ends of the tubular body 10. The outer ribs 11 are supported on these holding projections 16 and additionally cemented. In the form of embodiment shown in FIG. 2 the outer ribs 11 are constructed in the manner described with a complete U shape and supported on the holding projections 16. In the form of embodiment shown in FIG. 3 the U legs 13 are formed by the holding projections 16, and straight-through U crossbars 14 of synthetic mica are simply provided for forming the supporting edges 4 and are supported on shoulders 17 of the holding projections 16. In these two forms of embodiment the inner ribs 12, on whose supporting edges 5 the inner coil 3 is supported, are placed directly flat on to the periphery of the tubular body 10.

Figure 4:
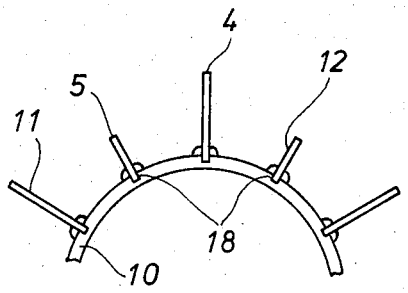
FIG. 4 shows a partial view of a further form of embodiment of the subject of FIG. 2.

In the form of embodiment shown in FIG. 4 the holding elements provided are axially disposed reception slots 18 which can be formed advantageously by extrusion. Both inner ribs 11 and outer ribs 12 are inserted in such reception slots 18. Moreover in all illustrated constructional examples the ribs 12, 11 are cemented to the tubular body 10 or the holding elements 16, 18 as the case may be.

What is claimed is:

1. Electrical heating element for fluid media, especially for hot air appliances, of the type having a support member of an insulating material and at least two heating conductors of resistance wire helically wound with a mutual radial spacing therebetween and supported on supporting edges of the support member, the improvement comprising the provision of a separate and independent set of supporting edges for each of said helically wound conductors, the height and peripheral location of the supporting edges of each set being different from set to set wherein each of said resistance wires is wound around the edges of a respective one of said sets of supporting edges with the turns of the wire resting axially spaced upon the edges of the respective set, and wherein the conductors are wound with differing pitches with respect to each other in a manner so that, when viewed in a radial direction, the turns of one of the two conductors are arranged at an intersecting angle with respect to the turns of the other of the two conductors.

2. Heating element according to claim 1, wherein the support member comprises a tubular body with ribs projecting radially at the periphery radially outer edges of, said ribs forming the supporting edges.

3. Heating element according to claim 2, wherein the heating conductors comprise radially outer and inner coils, and each of the outer ribs associated with the outer coil comprise in radial planes an axially extending U-profile with U-legs directed towards the tubular body and a U-crossbar forming the supporting edge, the U-legs and U-crossbar bounding a passage for the inner coil, which is supported on inner ribs.

4. Heating element according to claim 3, wherein at least the outer ribs are connected to the tubular body by means of holding elements.

5. Heating element according to claim 4, wherein the holding elements comprise holding projections which are formed on to the tubular body at the ends and on which the ribs are secured.

6. Heating element according to claim 4, wherein the holding elements comprise axially disposed reception slots into which the ribs are inserted.

7. Heating element according to claim 2, wherein the ribs are cemented to the tubular body.

8. Heating element according to claim 4, wherein the ribs are cemented to the holding elements.

9. Heating element according to claim 8, wherein the heating conductors comprise an outer coil consisting of a resistance wire of high specific power consumption and an inner coil consisting of a resistance wire of low specific power consumption.

10. Heating element according to claim 9, wherein the heating conductor of the inner coil comprises a resistance wire of small cross-section which is wound about a supporting core.

11. Heating element according to claim 9, wherein the heating conductor of the outer coil comprises a resistance wire of rectangular cross-section and a lengthwise sinuous shape.

12. Heating element according to claim 9, wherein the outer coil and inner coil are wound in opposite directions so that the windings of the respective helically wound conductors are non-parallel.

* * * * *